US008807456B2

(12) United States Patent
Morbio

(10) Patent No.: US 8,807,456 B2
(45) Date of Patent: Aug. 19, 2014

(54) DEVICE FOR DISPENSING AN AERATED JET OF WATER

(75) Inventor: Alberto Morbio, Brescia (IT)

(73) Assignee: Nikles Tec Italia S.r.l., Carpenedolo (IT)

( * ) Notice: Subject to any disclaimer, the term of this patent is extended or adjusted under 35 U.S.C. 154(b) by 586 days.

(21) Appl. No.: 13/147,123

(22) PCT Filed: Feb. 23, 2010

(86) PCT No.: PCT/IB2010/050790

§ 371 (c)(1), (2), (4) Date: Jul. 29, 2011

(87) PCT Pub. No.: WO2010/097756

PCT Pub. Date: Sep. 2, 2010

(65) Prior Publication Data

US 2011/0297759 A1 Dec. 8, 2011

(30) Foreign Application Priority Data

Feb. 24, 2009 (IT) ..... BS2009A0031

(51) Int. Cl.

| | |
|---|---|
| ***E03C 1/08*** | (2006.01) |
| ***B05B 7/06*** | (2006.01) |
| ***B05B 1/18*** | (2006.01) |
| ***B05B 7/04*** | (2006.01) |

(52) U.S. Cl.

CPC ..... *B05B 1/185* (2013.01); *B05B 7/0425* (2013.01)

USPC ..... 239/428.5; 239/429; 239/432

(58) Field of Classification Search

USPC ..... 239/428.5, 429–431, 432; 261/76, 78.1

See application file for complete search history.

(56) References Cited

U.S. PATENT DOCUMENTS

| | | | | |
|---|---|---|---|---|
| 5,111,994 | A * | 5/1992 | Gonzalez | 239/428.5 |
| 5,215,258 | A * | 6/1993 | Jursich | 239/394 |
| 7,913,934 | B2 * | 3/2011 | Schorn | 239/419.5 |
| 2006/0163391 | A1 | 7/2006 | Schorn | |
| 2008/0011880 | A1 | 1/2008 | Butzke et al. | |

FOREIGN PATENT DOCUMENTS

| | | |
|---|---|---|
| DE | 2821195 | 11/1979 |
| DE | 3706320 | 3/1988 |
| GB | 2311474 | 10/1997 |
| WO | 98/55704 | 12/1998 |

* cited by examiner

*Primary Examiner* — Justin Jonaitis
(74) *Attorney, Agent, or Firm* — Shoemaker and Mattare

(57) ABSTRACT

A device for dispensing an aerated jet of water comprises an outer casing (10), a dispenser plate (14) which closes said outer casing and in which a plurality of nozzles (16) for the outlet of the water is provided, and an intermediate plate (18) positioned in said casing so as to define a water inlet chamber (20) communicating with a water supply duct (21), and a water outlet chamber (24) communicating with the outlet nozzles (16) of the water. In the intermediate plate (18) there is provided an air-water mixing chamber (26) communicating with the water inlet chamber through a plurality of water inlet holes (28), with the outside environment through a number of air intake holes (30) and with the water outlet chamber through a plurality of aerated water (32) outlet holes.

13 Claims, 8 Drawing Sheets

DEVICE FOR DISPENSING AN AERATED JET OF WATER

The present invention relates to a dispenser device of an aerated jet of water, such as a handheld shower head, overhead shower head or bulb or dispenser head of a tap.

Dispenser devices of the type mentioned above have already been proposed, able to generate an aerated jet of water, that is mixed with air. These devices exploit the Venturi effect by which a flow of water passing at high speed through a duct placed in communication with the outside environment causes the aspiration of air which then mixes with the water thereby creating an aerated jet of water.

In some known devices special routes or ducts are provided for the flow of aerated water so that only some of the dispensing nozzles are used to produce a jet of aerated water.

In other devices, a single incoming jet of water is mixed with air and special guidance devices are provided to distribute such jet of aerated water all over the dispensing surface.

These known solutions in any case entail a more complex structure which considerably affects the number of construction parts, the dimensions of the device and the production, storage and servicing costs.

The purpose of the present invention is to propose a dispensing device of an aerated jet of water able to overcome the drawbacks mentioned above.

Such purpose is achieved by a dispensing device according to claim 1. The dependent claims describe preferred or advantageous embodiments of the dispensing device according to the invention.

The characteristics and advantages of the dispensing device according to the invention will be evident from the description given below of its preferred embodiments, made by way of a non-limiting example, with reference to the attached figures wherein.

Figure 1:
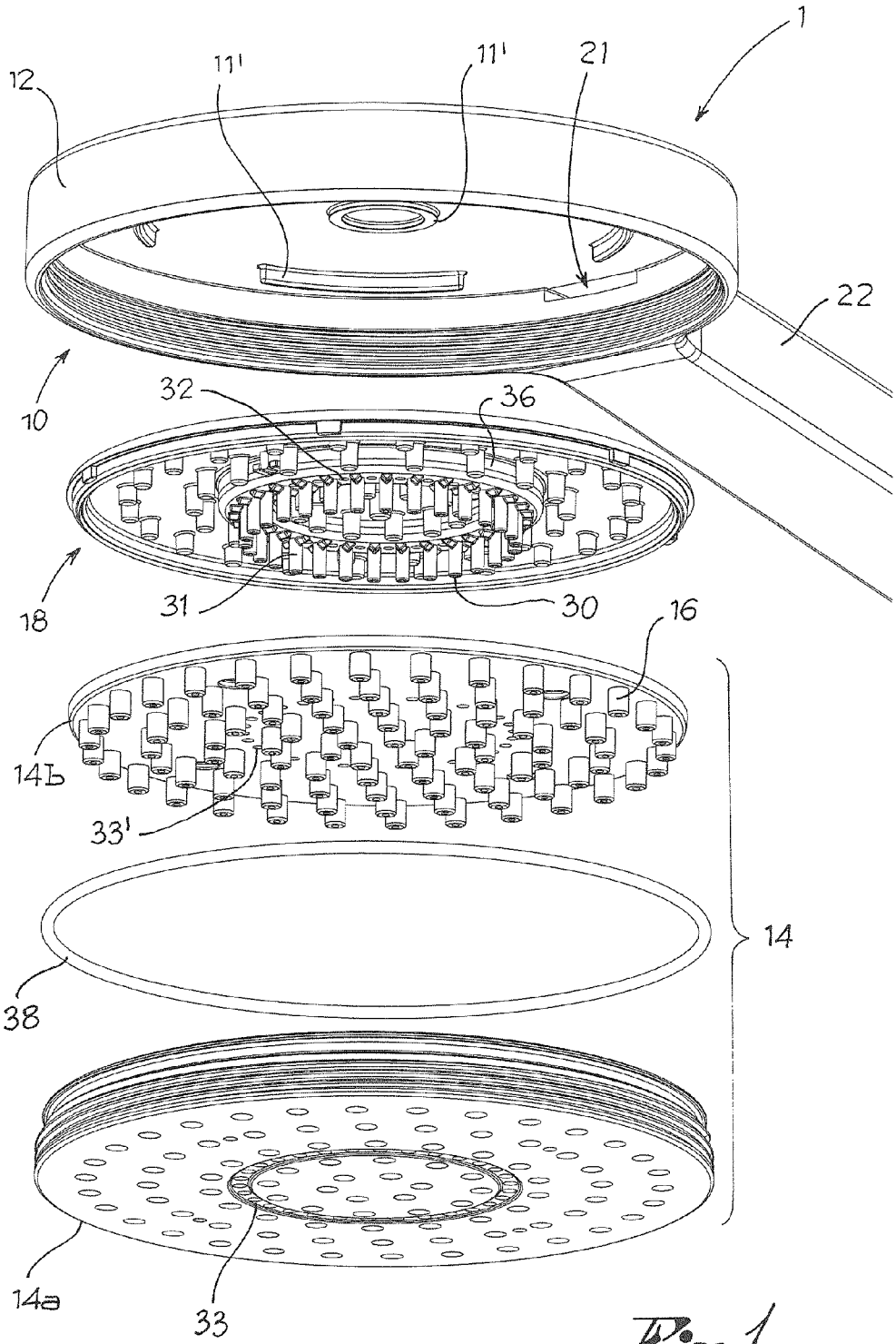
FIG. 1 is an exploded perspective view of the dispensing device according to the invention.
Figure 2:
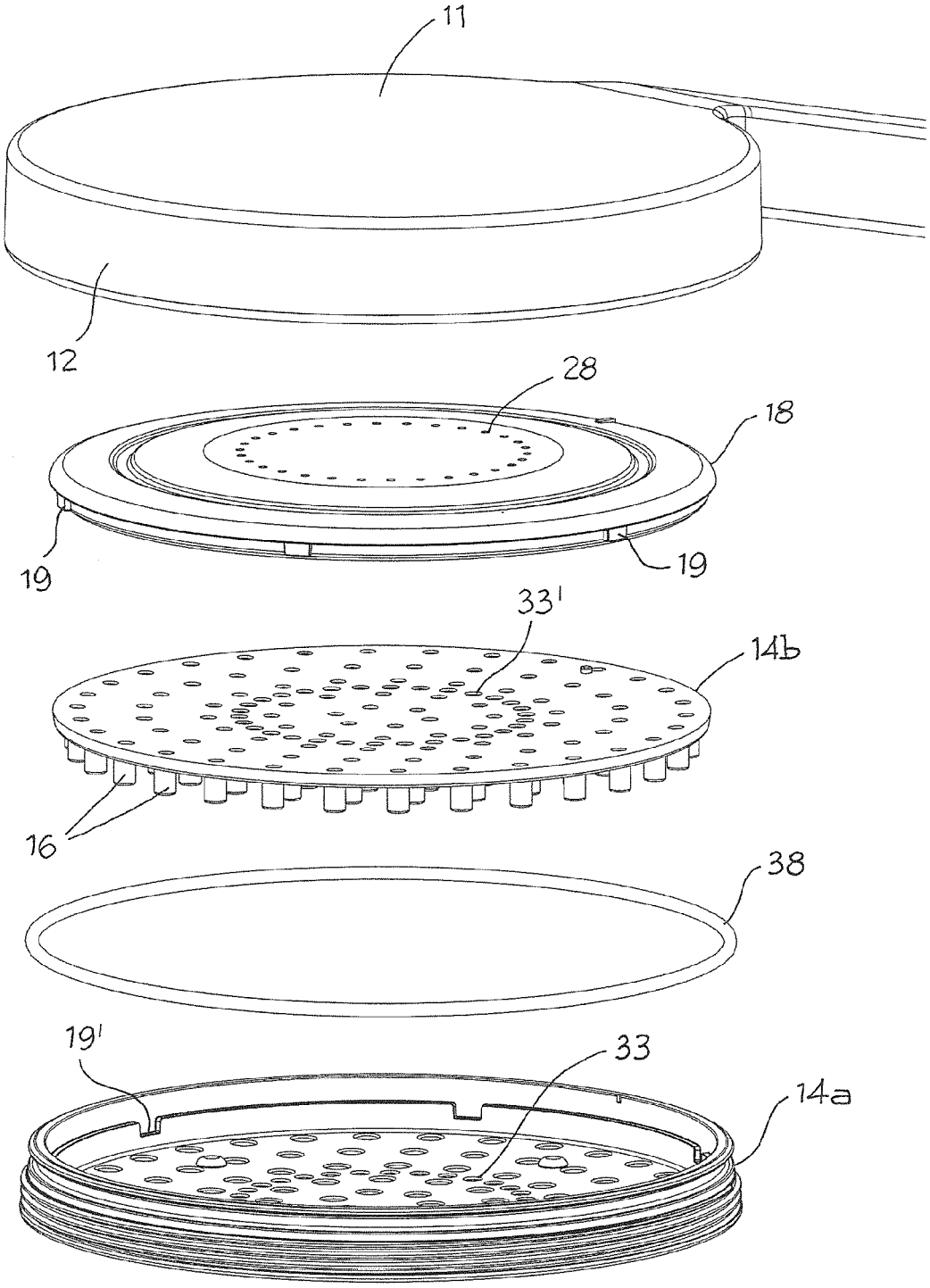
FIG. 2 is an exploded perspective view from above.
Figure 3:
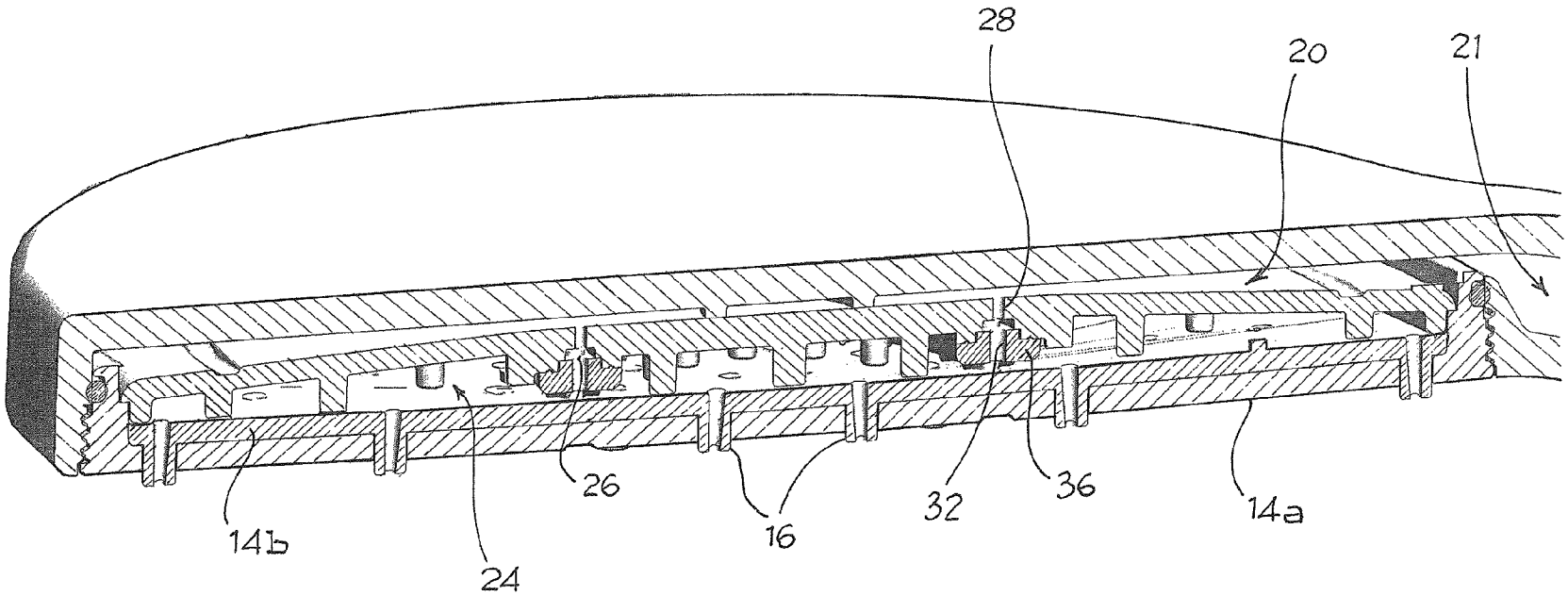
FIG. 3 is a cross-section of the assembled device, at the height of the aerated water outlet holes.
Figure 4:
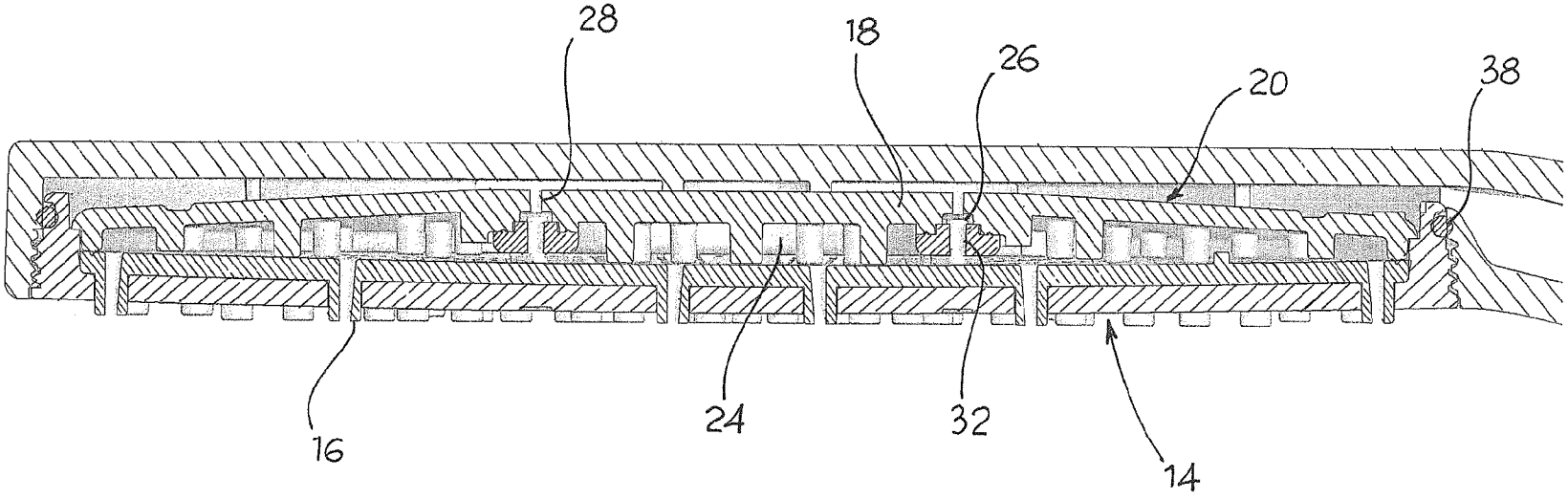
FIG. 4 is an axial section of the dispensing device, again at the height of the aerated water outlet holes.
Figure 4A:
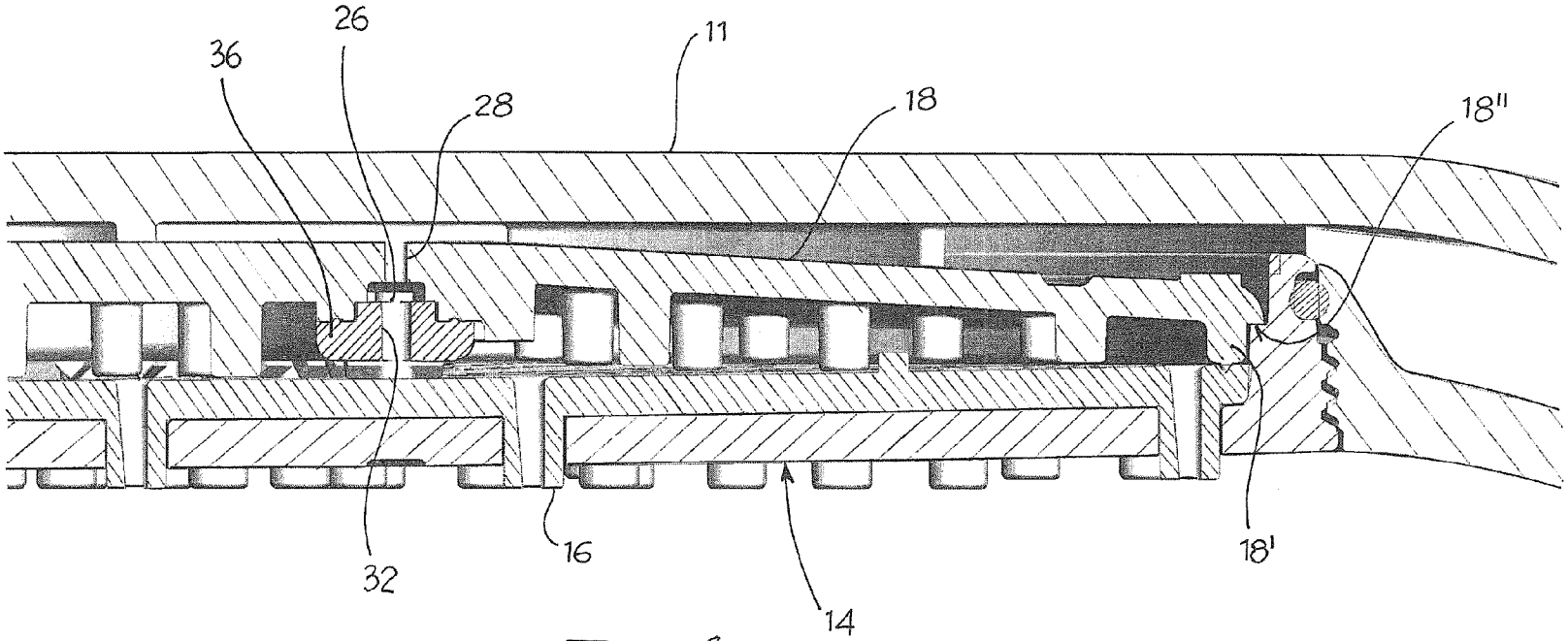
Figure 5:
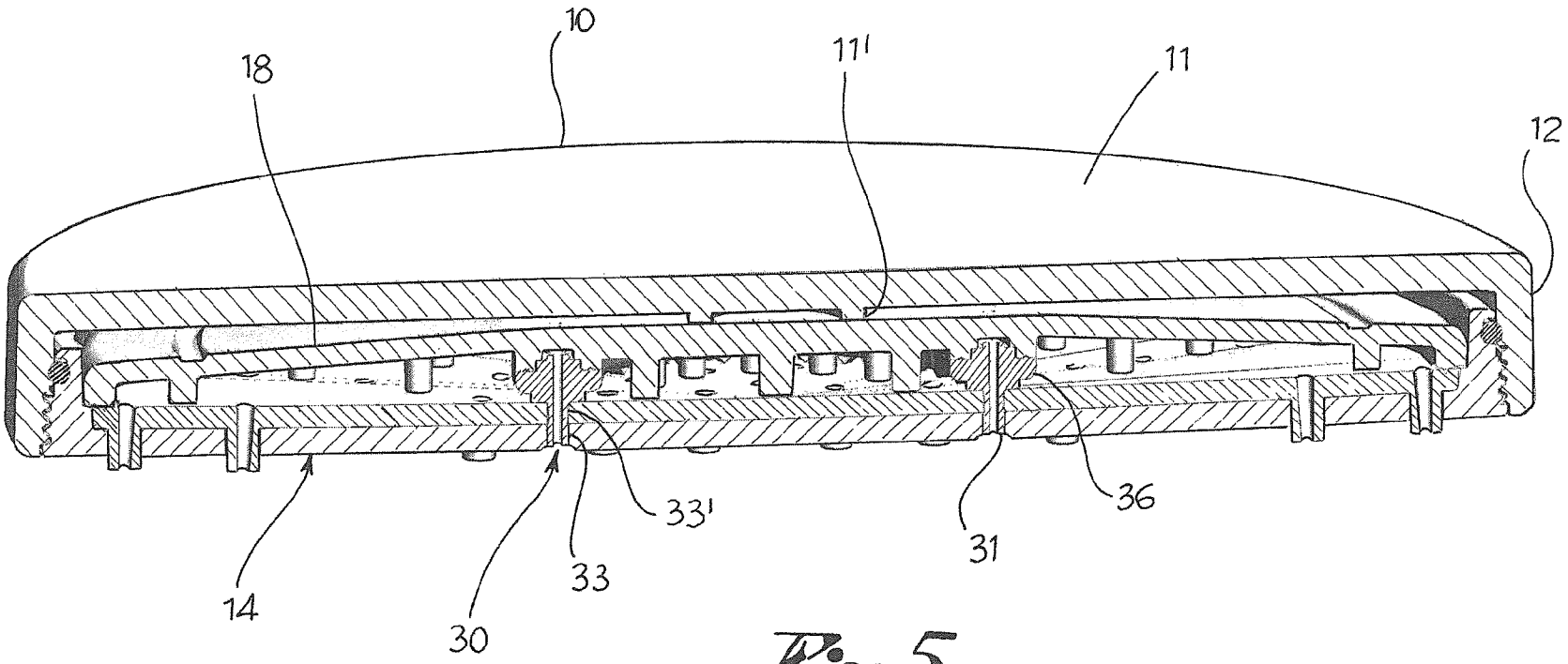
Figure 6:
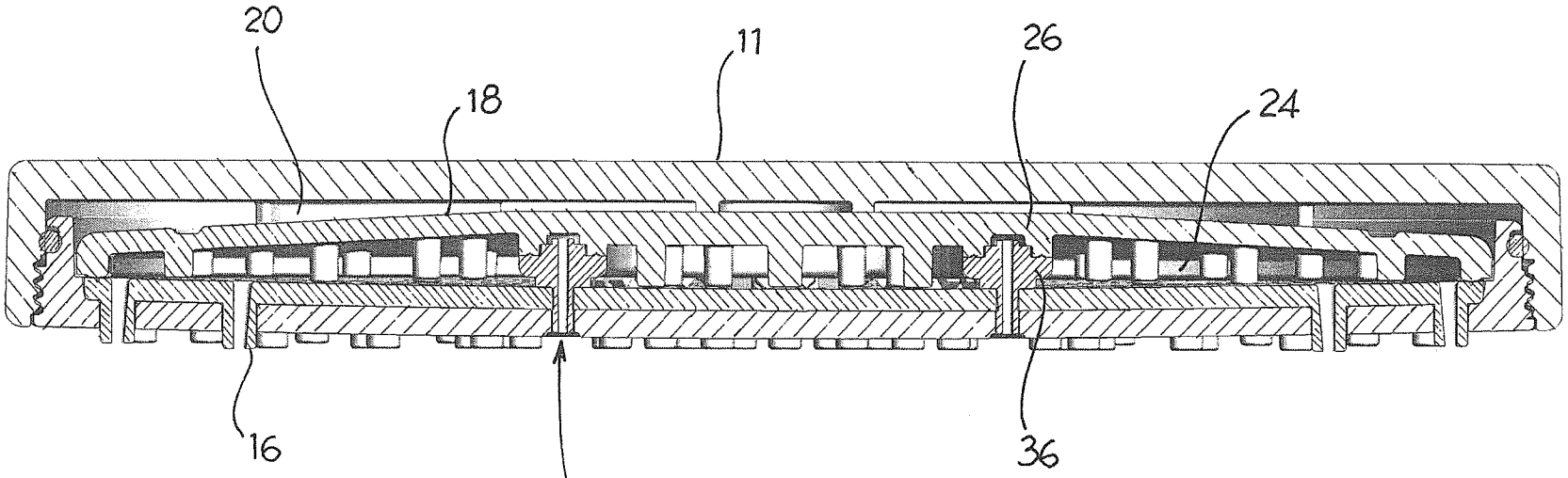
Figure 6A:
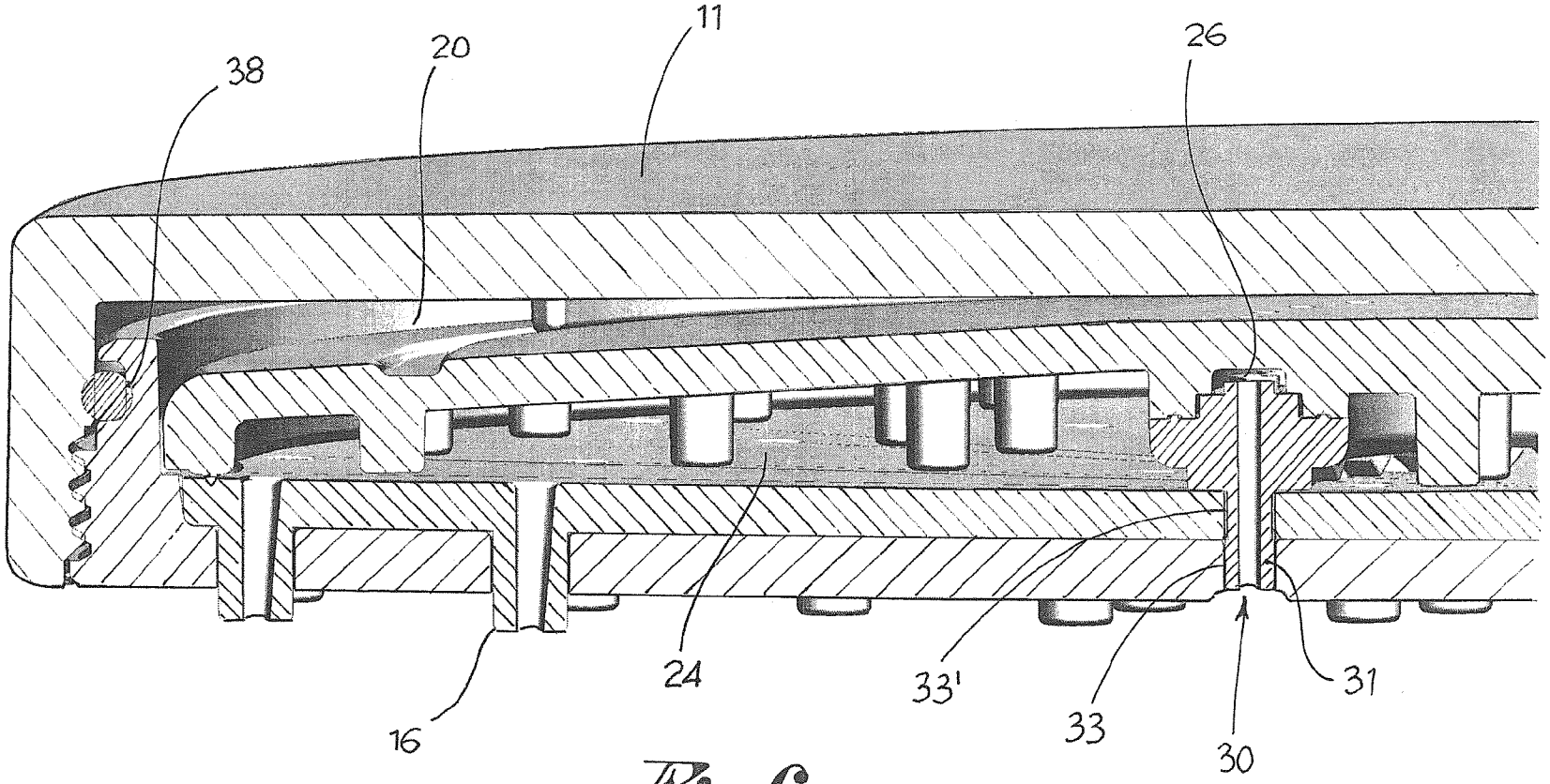

FIG. 4*a* is an enlarged view of a part of the section in FIG. 4;

FIG. 5 is a cross-section of the assembled device at the height of the air intake holes;

FIG. 6 is an axial section of the dispensing device, again at the height of the air intake holes; and FIG. 6*a* is an enlarged view of a part of the section in FIG. 6.

In said drawings, reference numeral 1 globally denotes a dispensing device of a jet of water according to the invention. The device 1 illustrated in the drawings is in the form of a hand held shower head, specifically of the type with a flat head, but the teaching of the present invention could also be implemented in an overhead or bulb shower head.

The device 1 comprises, in a general embodiment, an outer casing 10, comprising for example, considering for simplicity's sake the jet of aerated water facing downwards, a top wall 11 and a side wall 12, defining the height and thickness of said casing.

The outer casing 10 is closed underneath by a dispenser plate 14 in which there are a number of outlet nozzles 16 of the water. The outgoing jet of water from the dispenser plate is thus composed of a number of single small jets coming out of the respective nozzles 16. According to one embodiment, the outlet nozzles of the water are evenly distributed all over the surface of the dispenser plate 14.

Inside the casing 10 there is, in addition, an intermediate plate 18 positioned so as to define a water inlet chamber 20 communicating with a water supply duct 21, and a water outlet chamber 24 communicating with the outlet nozzles 16 of the water.

According to one embodiment, the intermediate plate 18 divides the inner volume of the casing into an upper, water inlet chamber 20, defined above by the top wall 11 and into which the water supply duct 21 flows, made for example in the handle 22 of the shower head, and a lower, water outlet chamber 24, defined below by the dispenser plate 14 and into which the outlet nozzles 16 open.

In the intermediate plate 18 a water-air mixing chamber 26 for the generation of a jet of aerated water is provided. This mixture chamber 26 communicates with the water inlet chamber 20 through a number of water inlet holes 28, with the outside environment through a number of air intake holes 30 and with the water outlet chamber 24 through a number of aerated water outlet holes 32.

According to one embodiment, the aerated water outlet holes 32 look and open directly onto the inner surface of the dispenser plate 14 so that the jets of aerated water coming out of said holes are evenly distributed throughout the water outlet chamber 24.

Considering for simplicity's sake the case of a circular shower head, as shown in the drawings, the aerated water outlet holes 32 are positioned along at least one circumference concentric to the dispenser plate having a radius essentially included between one-third and two-thirds of the radius of said plate 14.

According to one embodiment the water inlet holes 28 into the mixing chamber 26 are formed along at least one circumference concentric to the water inlet chamber and having a radius essentially included between one-third and two-thirds of the radius of said chamber.

Preferably, the air-water mixing chamber has an annular extension.

Advantageously the water inlet holes 28 in the mixing chamber 26 are aligned with the aerated water outlet holes 32 of the mixing chamber 26.

According to a preferred embodiment the air intake holes 30 are formed in respective air intake pipes 31 which extend from the intermediate plate 18, for example under the mixing chamber 26, and are inserted in the respective holes 33, 33' made in the dispenser plate.

According to one embodiment the air intake pipes 31 and the aerated air outlet holes 32 are formed in an annular element 36 sealed tight to the intermediate plate 18 so as to define with it the air-water mixing chamber 26.

As shown in the drawings, in one embodiment the outer casing, the water inlet chamber and the water outlet chamber are a flat shape, extending mainly in a direction orthogonal to that of the outgoing jet of water. In other words the thickness of the dispenser device is considerably less than its width. This version, as well as being particularly attractive and popular from an aesthetic point of view, makes it possible to obtain a considerably broad jet of aerated water, in terms of diameter of the jet, which is also very fine thanks to the high number of outlet nozzles 16 which can be distributed on the dispenser plate 14. At the same time the device proves lightweight and therefore easy to handle.

According to one embodiment the dispenser plate 14 forms a hermetic seal with the rim of the outer casing 10 to which it is attached. This way as well as preventing trickles of water from the rim of the device, the aspirated air is forced to enter solely through the intake holes 30 and therefore follow the route which takes it to the mixing chamber 26.

According to one embodiment the dispenser plate 14 comprises a perforated outer plate 14*a* which closes the outer casing forming a seal along the peripheral rim, and an inner plate 14*b* laid over the outer, having a number of dispensing nozzles 16 and in turn having through holes 33' for the passage of the air intake pipes 31.

Advantageously, the outer plate 14*a* is made in a rigid material, such as a metal or plastic material, while the inner plate 14*b* is made in a soft material, for instance rubbery, suitable for the removal of lime-scale.

For example the outer plate 14*a* is attached by screws to the outer casing 10 with a sealing element 38 such as an O-ring positioned between them.

Advantageously, in addition, the intermediate plate 18 has a peripheral rim 18' which laterally defines the water outlet chamber and which is sealed to the inner plate 14*b* of the dispenser plate. According to one embodiment the peripheral rim 18' rests on a step 18" made in the peripheral rim of the outer plate 14*a*. The intermediate plate 18 is also kept stably in position between the top wall 11 of the casing and the dispenser plate 14 by means of a projection 11', for example of an annular shape, extending downwards from the top wall 11 and going to rest against the upper surface of the intermediate plate.

Advantageously, to facilitate alignment of the air intake pipes 31 with the respective holes 33 made in the dispenser plate during the assembly phase, and prevent rotation of the intermediate plate 18 in relation to the dispenser plate 14, the intermediate plate is fitted with alignment teeth 19 which fit into respective recesses 19' made in the dispenser plate 14.

It should be noted that preferably the intermediate plate 18 is a convex or rounded shape, able to improve the incoming flow of water to the holes 28.

When a jet of water under pressure reaches the water inlet chamber 20, the water enters the mixing chamber 26 through the inlet holes 28 made in the intermediate plate 18. Since these inlet holes are aligned with the outlet holes 32, a high speed flow of water is generated which, thanks to the Venturi effect, causes the suction of air from the outside through the intake holes 30. The aspirated air then mixes with the flow of water creating a number of aerated jets of water. These aerated jets of water enter the water outlet chamber 24, fill it up and lastly come out of said chamber through the outlet nozzles 16.

The disposition of the mixing chamber and water inlet and outlet holes along a circumference concentric to the dispenser plate and with a radius essentially equal to half the radius of the latter, effectively enables the jets of aerated water coming out of the mixing chamber to distribute themselves evenly all over the dispenser plate, without requiring guidance by special devices. In other words, each jet of aerated water comes out in a point essentially intermediate to the centre of the dispenser plate and its rim. Thanks in part to the flattened shape of the water outlet chamber, the jets of aerated water coming out of the respective holes immediately find themselves faced with an obstacle constituted by the inner wall of the dispenser plate and therefore break, diverging both towards the centre and the periphery of the dispenser plate.

Clearly, the water outlet chamber immediately fills up with aerated water under pressure and the aerated water can therefore come out of the device in the form of single jets of aerated water through the outlet nozzles.

It should be emphasised that the presence of devices making it possible to obtain a jet of aerated water does not entail a significant increase in size or in the complexity of the structure compared to a similar device producing a jet of non-aerated water.

In fact, the aeration system proposed entails only the addition of an intermediate plate which the mixing chamber is made in, for example by merely attaching a perforated annular element to its central part. It should be noted that the rounded form of the intermediate plate makes it possible to make the mixing chamber under the central portion of the intermediate plate, further from the dispenser plate, without entailing an increase in the overall thickness of the outer casing and therefore of the device. The dispenser plate too does not differ from that of a traditional plate, except for the presence of a further row of holes for the passage of the air intake pipes.

A person skilled in the art may make modifications, adaptations and replacements of elements with others functionally equivalent to the embodiments of the dispenser device according to the invention so as to satisfy contingent requirements while remaining within the scope of protection of the following claims. Each of the characteristics described as belonging to one possible embodiment may be realised independently of the other embodiments described.

The invention claimed is:

1. Device for dispensing an aerated jet of water, comprising:

an outer casing, a dispenser plate which closes said outer casing and in which a plurality of nozzles for the outlet of the water are provided, an intermediate plate positioned in said casing so as to define a water inlet chamber communicating with a water supply duct, and a water outlet chamber communicating with the outlet nozzles of the water, wherein in said intermediate plate there is provided an air-water mixing chamber having and communicating with the water inlet chamber through a plurality of water inlet holes, with the outside environment through a number of air intake holes and with the water outlet chamber through a plurality of aerated water outlet holes, wherein the air intake holes are made in respective air intake pipes which extend from the intermediate plate and which are inserted in respective holes made in the dispenser plate, and wherein the air intake pipes and the outlet holes of the aerated air are made in an annular element sealed tight to the intermediate plate so as to define with it the air-water mixing chamber.

2. Device according to claim 1, wherein the outlet nozzles of the water are evenly distributed all over the surface of the dispenser plate, and wherein the outlet holes of the aerated water look and open directly onto the inner surface of said dispenser plate so that jets of aerated water coming out of said holes are evenly distributed through the water outlet chamber.

3. Device according to claim 2, wherein the outlet holes of the aerated water are positioned along at least one circumference concentric to the dispenser plate and having a radius essentially included between one-third and two-thirds of the radius of said plate.

4. Device according to claim 1 wherein the inlet holes of the water into the mixing chamber are disposed along at least one circumference concentric to the water inlet chamber and having a radius essentially included between one-third and two-thirds of the radius of said chamber.

5. Device according to claim 1, wherein the water inlet holes (28) are aligned with the outlet holes of the aerated water.

6. Device according to claim 1, wherein the air intake holes go through the dispenser plate.

7. Device according to claim 6, wherein said air intake holes are distributed along the circumference of the outlet holes of the jets of aerated water and are alternated with said outlet holes.

8. Device according to claim 1, wherein the outer casing, the water inlet chamber and the water outlet chamber are of a flat shape, extending mainly in a direction orthogonal to that of the outgoing jet of water.

9. Device according claim 1, wherein the dispenser plate forms a hermetic seal with the rim of the outer casing to which it is attached.

10. Device according to claim 9, wherein the dispenser plate comprises a perforated outer plate which closes the outer casing forming a seal along the peripheral rim, and an inner plate laid over the outer plate, having a number of dispensing nozzles and in turn perforated for the passage of the air intake pipes.

11. Device according to claim 9, wherein the outer plate is made in rigid material, such as a metal or plastic material, and wherein the inner plate is made in a soft material suitable for the removal of lime-scale.

12. Device according to claim 11, wherein the intermediate plate has a peripheral rim which laterally defines the water outlet chamber and which is sealed to the inner plate of the dispenser plate.

13. Device according claim 1, wherein the intermediate plate and the dispenser plate are fitted with complementary alignment devices able to prevent their rotation in relation to one another.

* * * * *